US007459651B2

(12) United States Patent
Chyc et al.

(10) Patent No.: US 7,459,651 B2
(45) **Date of Patent: *Dec. 2, 2008**

(54) PRINTED CIRCUIT BOARD FOR A MOBILE DEVICE

(75) Inventors: Paul Robert Chyc, Broomfield, CO (US); Roman Peter Rak, Waterloo (CA); Jason Griffin, Waterloo (CA); Steven Fyke, Fort Erie (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/342,577

(22) Filed: Jan. 31, 2006

(65) Prior Publication Data

US 2006/0118400 A1 Jun. 8, 2006

Related U.S. Application Data

(63) Continuation of application No. 10/912,338, filed on Aug. 6, 2004, now Pat. No. 7,026,566.

(30) Foreign Application Priority Data

Aug. 7, 2003 (GB) ..... 0318532.9

(51) Int. Cl.
*H01H 13/70* (2006.01)

(52) U.S. Cl. ..... 200/512; 200/5 A; 200/516

(58) Field of Classification Search ..... 200/512–517, 200/5 A, 5 R, 17 R, 18, 341–345; 400/472, 400/473, 479
See application file for complete search history.

(56) References Cited

U.S. PATENT DOCUMENTS

| | | | | |
|---|---|---|---|---|
| 5,115,108 | A | 5/1992 | Ogawa et al. | 200/1 B |
| 5,717,176 | A | 2/1998 | Dahlstrom | 200/1 B |
| 5,952,629 | A | 9/1999 | Yoshinaga et al. | 200/5 A |
| 6,303,887 | B1 | 10/2001 | Ando | 200/512 |
| 6,653,586 | B2 | 11/2003 | Hsiung et al. | 200/517 |
| 6,670,562 | B2 | 12/2003 | Kaneko | 200/1 B |
| 2002/0054676 | A1 | 5/2002 | Zhao et al. | |

FOREIGN PATENT DOCUMENTS

| | | |
|---|---|---|
| EP | 1 146 531 | 10/2001 |
| EP | 1146531 A1 * | 10/2001 |
| GB | 2 324 414 | 10/1998 |
| GB | 2 364 173 | 1/2002 |
| WO | WO 99/44212 | 9/1999 |

* cited by examiner

*Primary Examiner*—Elvin Enad
*Assistant Examiner*—Marina Fishman
(74) *Attorney, Agent, or Firm*—Borden Ladner Gervais LLP; Jeffrey W. Wong

(57) ABSTRACT

A printed circuit board is provided for use in a keyboard assembly of a mobile device having a plurality of keys in a key layout. The printed circuit board has a plurality of contacts, such as dome switches, arranged in a contact layout. The contact layout is such that it can be used with a plurality of different key layouts, each actuating different combinations of contacts. Some keys in a particular key layout are overlying at least two of the plurality of contacts, and such keys actuate only one of the underlying contacts. As such, a common printed circuit board can be used for a plurality of complementary mobile device designs having different key layouts, thereby allowing a manufacturer to realize cost efficiencies.

8 Claims, 2 Drawing Sheets

PRINTED CIRCUIT BOARD FOR A MOBILE DEVICE

CROSS REFERENCE TO RELATED APPLICATIONS

This application is a continuation of U.S. patent application Ser. No. 10/912,338, filed Aug. 6, 2004, now U.S. Pat. No. 7,026,566 which claims priority to GB Patent Application No. 0318532.9 filed Aug. 7, 2003, the contents of which are expressly incorporated herein by reference.

FIELD OF THE INVENTION

The present invention relates generally to mobile devices having a keyboard or keypad. More particularly, the present invention relates to a printed circuit board for a mobile device having a keyboard or keypad.

BACKGROUND OF THE INVENTION

Many mobile devices, such as cellular telephones, personal digital assistants (PDAs), and other handheld and wireless computing and communicating devices, currently perform numerous and complex functions. Many voice-based services are designed for use with a telephone keypad and numeric entry, whereas many data-based services are designed for use with a QWERTY keyboard and text entry.

Mobile device manufacturers now produce a full range of mobile devices with different key layouts, including the traditional telephone keypad layout, the traditional QWERTY keyboard layout, and many other variations thereon including custom key layouts. However, one drawback for the manufacturers is that typically a different printed circuit board (PCB) is required for each key layout used on a different device. This is due to the fact that there is usually a one-to-one relationship between each contact, or dome switch, on the printed circuit board of the mobile device and each key in the key layout. As such, although a common mobile device housing may be used for devices having different key layouts, a different PCB is required for each key layout, resulting in increased cost to the manufacturer, which is typically passed on to the purchaser.

SUMMARY OF THE INVENTION

In one aspect, the present invention provides a printed circuit board for a keyboard assembly for use in a mobile device, the keyboard assembly having a plurality of keys in a key layout. The printed circuit board includes a plurality of contacts arranged in a contact layout for actuation by different combinations of keys in different key layouts. In one of the different key layouts, at least two of the plurality of contacts underlies each of at least one key of the plurality of keys, the at least one key for actuating only one of the at least two of the plurality of contacts.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, a printed circuit board for use in a keyboard assembly of a mobile device having a plurality of keys in a key layout is provided. The printed circuit board has a plurality of contacts, such as dome switches, arranged in a contact layout. The contact layout is such that it can be used with a plurality of different key layouts, each actuating different combinations of contacts. Some keys in a particular key layout are overlying at least two of the plurality of contacts, and such keys actuate only one of the underlying contacts. As such, a common printed circuit board can be used for a plurality of complementary mobile device designs having different key layouts, thereby allowing a manufacturer to realize cost efficiencies.

Figure 1:
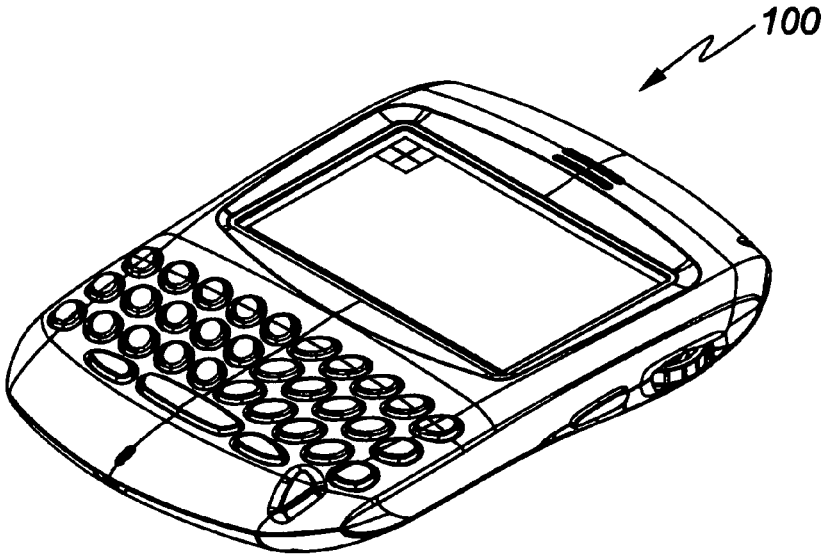
FIG. 1 is a perspective view of a mobile device having a first key layout.

FIG. 1 is a perspective view of a mobile device having a first key layout. The mobile device 100 typically includes a display area, an earpiece or speaker area, and a microphone area. The first key layout shown in FIG. 1 is a typical QWERTY keyboard layout, and can be any variation thereon. The shape and relative positioning of the keys is not material to the layout. Rather, it is the relationship between the keys in the key layout and the underlying contacts on the PCB that is of interest. Although the description herein will refer primarily to the QWERTY keyboard layout, it is to be understood that the present invention can be used with any number of keyboard layouts, such as QWERTZ (used in Germany), AZERTY (used in France), Dvorak, and alphabetic.

Figure 2:
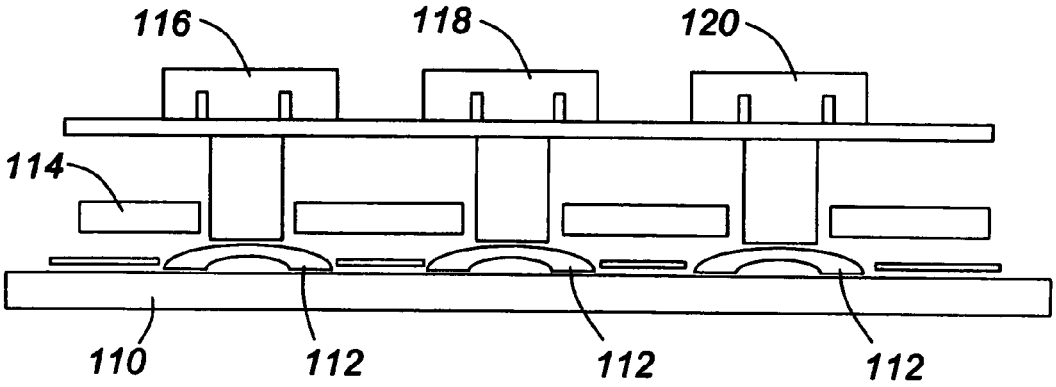
FIG. 2 is a simplified graphic view of the interaction of keys in the first key layout of FIG. 1 with a printed circuit board for a mobile device according to an embodiment of the present invention.

FIG. 2 is a simplified graphic view of the interaction of keys in the first key layout of FIG. 1 with a printed circuit board for a mobile device according to an embodiment of the present invention. A printed circuit board (PCB) 110 is provided having a plurality of contacts 112 arranged in a contact layout. The PCB can be part of, or for assembly in, a keyboard assembly for use in a mobile device, the keyboard assembly having a plurality of keys 116, 118, and 120 in a key layout. The contacts 112 can be dome switches, as shown in FIG. 2, or can be implemented in any number of other manners, such as having the contacts printed directly on the PCB. The contacts can also be provided on the PCB as a combination of these different types of contacts.

The plurality of contacts are arranged in a contact layout for actuation by different combinations of keys in different key layouts. In at least one of those different key layouts, at least two of the plurality of contacts underlies each of at least one key of the plurality of keys, such that the at least one key actuates only one of the at least two of the plurality of underlying contacts when the key itself is actuated. It is to be understood that although only three contacts are shown in FIG. 2, the contact layout can comprise a plurality of contacts arranged in a plurality of rows and/or columns. Also, the spacing between the contacts need not be uniform in any particular row, but is preferably arranged to correspond with a key layout, or more appropriately a plurality of key layouts, with which the PCB is intended to be used.

An optional backlight element 114 is shown in FIG. 2. The backlight element 114 can be an electroluminescent (EL) panel, or can alternatively incorporate light emitting diode (LED) technology, Cold Cathode Fluorescent Tube (CCFT) technology, and/or similar backlighting to illuminate the keyboard key's keycap and/or artwork on the key, such as lettering or numbering indicating the function of the key. When the optional backlight element 114 is employed, each key preferably includes a light pipe for allowing backlighting to be transmitted from the underlying backlight element to the key. The keys can also preferably be constructed of a translucent material in order to facilitate transmission of light from the backlight element to the keys.

Figure 3:
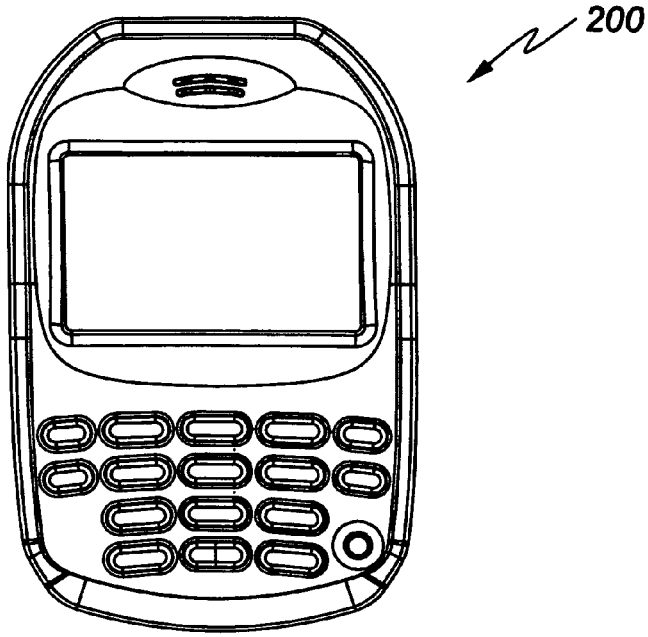
FIG. 3 is a front view of a mobile device having a second key layout.

FIG. 3 is a front view of a mobile device 200 having a second key layout. More particularly, the second key layout is a traditional telephone keypad, or dial key, layout, or a variation thereon. The particular layout shown in FIG. 3 includes wide keys to facilitate the use thereof as well as to allow for greater backlight transmissivity because of the increased surface area.

Figure 4:
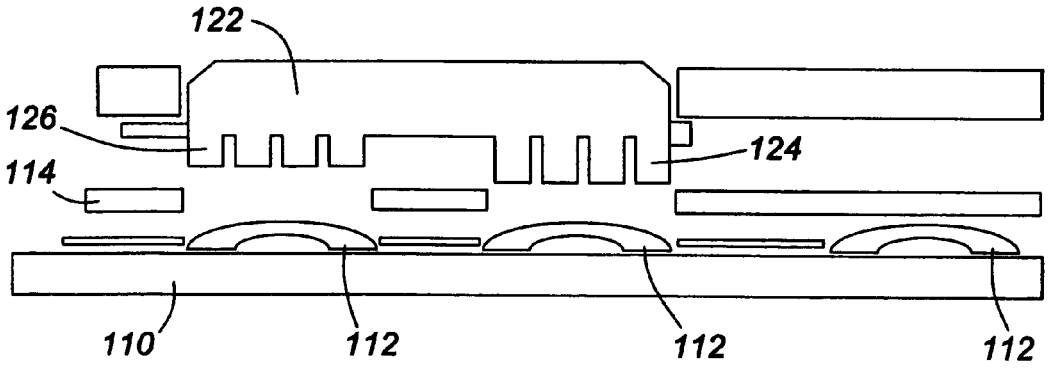
FIG. 4 is a simplified graphic view of the interaction of keys in the second key layout of FIG. 3 with a printed circuit board for a mobile device according to an embodiment of the present invention.

FIG. 4 is a simplified graphic view of the interaction of keys in the second key layout of FIG. 3 with a printed circuit board for a mobile device according to an embodiment of the present invention. At least one of the keys in the second keyboard layout is provided as shown in FIG. 4 as key 122, with preferably many of the keys being as such. Each key 122 in the second keyboard layout has a keyboard actuator end 124 and a non-actuating end 126.

When optional backlight element 114 is present, each key 122 preferably includes at least one light pipe at each end thereof for allowing backlighting to be transmitted from the underlying backlight element 114. The light pipe protrusion under the non-actuating end 126 of the key 122 is shorter than that under the actuator end 124, so that it does not activate the key underneath it when the key 122 is pressed. The key 122 can be made from translucent material to couple backlighting from the backlight element 114, for example from an EL panel, beneath the keys.

As can be seen from FIG. 4, the at least one key 122 overlies, or overlaps, two underlying contacts 112. The mechanical implementation is such that the key mechanism only activates one of the two underlying contacts 112. This activation permits the dial key layout in the second key layout to be different than the layout of the QWERTY keyboard in the first key layout. With a simple one-to-one relationship between keys of the mobile device and contacts on the PCB 110 keys on the keyboard, it would not be possible to have a PCB 110 that is able to be used with a plurality of key layouts, such as a telephone keypad layout and a QWERTY keyboard layout.

It is readily apparent that the teachings of the present invention also encompass a mobile device including a printed circuit board as discussed in detail above.

Therefore, it can be seen that embodiments of the present invention provide a printed circuit board for use with a mobile device, and particularly in a keyboard assembly of a mobile device having a plurality of keys in a key layout. The printed circuit board has a plurality of contacts, such as dome switches, arranged in a contact layout. The contact layout is such that it can be used with a plurality of different key layouts each actuating different combinations of contacts. As such, the same printed circuit board can be used in a plurality of complementary mobile device designs having different key layouts, thereby allowing a manufacturer to realize cost efficiencies. The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A printed circuit board and keyboard assembly for use in a mobile device, the keyboard assembly having a plurality of keys in a key layout, the printed circuit board comprising:

a plurality of contacts arranged in a contact layout for actuation by different combinations of keys in different key layouts, at least two of the plurality of contacts underlying each of at least one key of the plurality of keys in one of the different key layouts, the at least one key for actuating only one of the at least two of the plurality of contacts;

wherein at least some of the contacts are dome switches.

2. The printed circuit board of claim 1 wherein the contact layout is arranged to correspond with key positions in the different key layouts.

3. The printed circuit board of claim 1 wherein the contacts are arranged in rows.

4. The printed circuit board of claim 1 wherein the contacts are arranged in columns.

5. The printed circuit board of claim 1 wherein at least some of the contacts are printed on the printed circuit board.

6. The printed circuit board of claim 1 wherein the plurality of keys are arranged in a QWERTY keyboard layout.

7. The printed circuit board of claim 1 wherein the plurality of keys are arranged in a telephone keypad layout.

8. The printed circuit board of claim 1 wherein the plurality of keys are arranged in a key layout selected from the group consisting of: QWERTY, AZERTY, Dvorak, and alphabetic.

* * * * *